US008480321B2

(12) United States Patent
Aihara et al.

(10) Patent No.: US 8,480,321 B2
(45) Date of Patent: Jul. 9, 2013

(54) RECORDING MEDIA TRANSPORTING APPARATUS AND A PRINTER

(75) Inventors: Yuichi Aihara, Yamanashi-ken (JP); Tsuyoshi Kubota, Yamanashi-ken (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 676 days.

(21) Appl. No.: 12/656,327

(22) Filed: Jan. 26, 2010

(65) Prior Publication Data

US 2010/0189489 A1 Jul. 29, 2010

(30) Foreign Application Priority Data

Jan. 29, 2009 (JP) ..... 2009-018301

(51) Int. Cl.
*B41F 35/00* (2006.01)
*B41L 41/00* (2006.01)
*B41J 29/17* (2006.01)

(52) U.S. Cl.
USPC ..... 400/701; 101/425

(58) Field of Classification Search
USPC ..... 101/423, 425; 400/701, 702, 578, 400/582; 347/172
See application file for complete search history.

(56) References Cited

U.S. PATENT DOCUMENTS

| | | | | |
|---|---|---|---|---|
| 6,587,135 | B1 * | 7/2003 | Suzuki et al. | 347/217 |
| 6,762,780 | B2 * | 7/2004 | Tsuruta et al. | 347/171 |
| 7,890,004 | B2 * | 2/2011 | Fujii et al. | 399/45 |
| 7,900,917 | B2 * | 3/2011 | Fujiwara et al. | 271/265.04 |
| 8,099,033 | B2 * | 1/2012 | Cahill | 399/327 |

FOREIGN PATENT DOCUMENTS

| | | |
|---|---|---|
| JP | H02-169444 | 6/1990 |
| JP | 2008-162114 | 7/2008 |

* cited by examiner

*Primary Examiner* — Ren Yan
*Assistant Examiner* — Marissa Ferguson Samreth
(74) *Attorney, Agent, or Firm* — Manabu Kanesaka

(57) ABSTRACT

A printer has a substantially linear transport path P1 in which a card C is transported, roller 41 provided on the transport path P1 to transport the card C, roller 42 spaced apart from the roller 41 on the transport path P1 to transport the card C to the opposite side to the roller 41, cleaning roller 31 that is disposed opposite to the roller 41 on the transport path P1 and that has an adhesive portion for cleaning the surface of the card C, and control section 95 for controlling the rotation velocity of the roller 31 to rotate the roller 31 at least at rotation velocity V1 and at rotation velocity V2 lower than the rotation velocity V1, where the control section 95 controls the rotation velocity of the roller 31 from the rotation velocity V1 to the rotation velocity V2 for a period during which the front end of the card C reaches the roller 41 from the cleaning roller 31.

14 Claims, 11 Drawing Sheets

RECORDING MEDIA TRANSPORTING APPARATUS AND A PRINTER

BACKGROUND OF THE INVENTION

The present invention relates to a recording media transporting apparatus and a printer, and more particularly, to a recording media transporting apparatus provided with a cleaning rotating body having an adhesive portion to clean the surface of recording media, and a printer provided with the recording media transporting apparatus.

DESCRIPTION OF RELATED ART

Conventionally, a printer has been known, for example, in Japanese Laid-Open Patent Publication No. 2008-162114, where the printer has a recording media transporting apparatus which transports recording media before printing processing in a printing section having a print head, while cleaning the photographic (printing) surface of the recording media in producing recording media such as credit cards, cash cards, license cards and IC cards.

As shown in FIG. 9, in this type of recoding media transporting apparatus, a transport roller 41 for transporting a recording medium (card C) and transport rollers 42 disposed on the downstream side of the transport roller 41 are disposed on a substantially linear card transport path P1 on which the card C is transported. Generally, the transport rollers 42 are comprised of one roller that is a driving roller and another roller that is a driven roller as a roller pair through the card transport path P1, and at least one roller can be a driving roller. Further, the transport rollers 41 and 42 are not necessarily limited to rollers, and may be belts extended between pulleys, for example.

Further, a cleaning roller 31 (cleaning rotating body) is disposed opposite to the transport roller 41 via the card transport path P1, and has an adhesive portion for cleaning the surface of the card C. The cleaning roller 31 nips the card together with the transport roller 41, and cleans the surface of the card C transported on the card transport path P1. Therefore, in the printer as described in Patent Document 1, it is possible to prevent deterioration of print quality of the card C printed in the printing section.

However, when the adhesive strength is strong in the adhesive portion of the cleaning roller 31, a phenomenon occurs that the card C is warped due to the adhesive strength in the adhesive portion of the cleaning roller 31. Particularly, when the thickness of the card C is thin, this phenomenon is noticeable. Then, when the card C is transported while being off the card transport path P1 and reaches the transport rollers 42, the card C runs on the transport roller 42, and a jam occurs. Therefore, conventionally, this problem has been handled by reducing the adhesive strength in the adhesive portion of the cleaning roller 31.

In addition, in association with the invention, for example, techniques relating to a thickness detection apparatus for detecting a thickness of recording media are disclosed in Japanese Laid-Open Patent Publication No. H02-169444.

However, in the conventional recording media transporting apparatus, since the adhesive strength is reduced in the adhesive portion of the cleaning roller 31, the recording media are not cleaned completely, and it is inevitable that the print quality degrades in the printing section in the printer.

Meanwhile, if the media are transported while decreasing the rotation velocity of the cleaning roller 31 i.e. transport speed of recording media from the beginning, the above-mentioned problem can be resolved even when the adhesive strength is strong in the adhesive portion of the cleaning roller 31. However, it is inevitable that the function deteriorates as a recording media transporting apparatus, and therefore a printer.

In view of the aforementioned matters, it is an object of the invention to provide a recording media transporting apparatus and printer capable of properly transporting recording media without undergoing the effect of adhesive strength of the surface of a cleaning rotating body.

SUMMARY OF THE INVENTION

To attain the object, a first aspect of the invention is characterized by having a substantially linear transport path in which a recording medium is transported, first transport means provided on the transport path to transport the recording medium, second transport means spaced apart from the first transport means on the transport path to transport the recording medium to the opposite side to the first transport means, a cleaning rotating body that is disposed opposite to the first transport means on the transport path and that has an adhesive portion for cleaning a surface of the recording medium, and control means for controlling a rotation velocity of the cleaning rotating body to rotate the body at least at a first rotation velocity and at a second rotation velocity lower than the first rotation velocity, where the control means controls the rotation velocity of the cleaning rotating body from the first rotation velocity to the second rotation velocity for a period during which a front end of the recording medium reaches the second transport means from the cleaning rotating body.

A recording media transporting apparatus of the first aspect is provided with the substantially linear transport path in which a recording medium is transported, and on the transport path are provided the first transport means for transporting the recording medium, the second transport means spaced apart from the first transport means to transport the recording medium in the opposite side to the first transport means, and the cleaning rotating body that is disposed opposite to the first transport means and that has the adhesive portion for cleaning the surface of the recording medium. The cleaning rotating body rotates at least at the first rotation velocity and second rotation velocity lower than the first rotation velocity, and the control means controls the rotation velocity. In other words, the control means controls the rotation velocity of the cleaning rotating body from the first rotation velocity to the second rotation velocity for a period during which the front end of the recording medium reaches the second transport means from the cleaning rotating body. The surface of the recording medium is cleaned by the cleaning rotating body when the medium is transported to the second transport means side by the first transport means, the cleaning rotating body is controlled by the control means to the second rotation velocity that is a low rotation velocity from the first rotation velocity before the front end of the recording medium reaches the second transport means, and therefore, even when the adhesive strength (cleaning strength) is strong in the adhesive portion of the cleaning rotating body, it is possible to prevent the recording medium from significantly rolling back due to the adhesive strength of the adhesive portion. Accordingly, according to the first aspect, since the rotation velocity of the cleaning rotating body is controlled by the control means from the first rotation velocity to the second rotation velocity before the front end of the recording medium reaches the second transport means, it is possible to prevent the recording medium from significantly rolling back due to the adhesive strength of the adhesive portion even when the adhesive strength is strong in the adhesive portion of the cleaning rotating body, and it is possible to clean the recording medium without undergoing the effect of the adhesive strength of the cleaning rotating body.

In the first aspect, a form is preferable which further has information acquiring means for acquiring information on a thickness of the recording medium, where corresponding to the information on the thickness of the recording medium acquired in the information acquiring means, when the thickness of the recording medium is thinner than a beforehand set predetermined thickness, the control means controls the rotation velocity of the cleaning rotating body from the first rotation velocity to the second rotation velocity for a period during which the front end of the recording medium reaches the second transport means from the cleaning rotating body. In such a form, as well as the above-mentioned action effect being exhibited, since the control means reduces the rotation velocity from the first rotation velocity to the second rotation velocity for a recording medium thinner than a predetermined thickness that significantly rolls back due to the adhesive strength of the adhesive portion of the cleaning rotating body, it is possible to suppress a jam caused by the recording medium running on the second transport means. In this form, the information on the thickness of the recording medium acquired in the information acquiring means is information of the thickness of the recording medium, and the control means may determine whether or not the thickness of the recording medium acquired in the information acquiring means is thinner than a predetermined thickness, and control the rotation velocity of the cleaning rotating body from the first rotation velocity to the second rotation velocity in a positive determination, while maintaining the first rotation velocity without reducing to the second rotation velocity in a negative determination. Alternately, the information on the thickness of the recording medium acquired in the information acquiring means is information indicating whether or not the thickness of the recording medium is thinner than the predetermined thickness, and the control means may control the rotation velocity of the cleaning rotating body from the first rotation velocity to the second rotation velocity when the information acquired in the information acquiring means indicates that the thickness of the recording medium is thinner than the predetermined thickness, while maintaining the first rotation velocity without reducing to the second rotation velocity when the information acquired in the information acquiring means indicates that the thickness of the recording medium is thicker than or the same as the predetermined thickness.

Further, in the first aspect, the second transport means is a roller pair, and space may be formed between the cleaning rotating body and a roller of the roller pair disposed on the same side as the cleaning rotating body via the transport path. Furthermore, the recording medium may be transported to the second transport means side while being nipped by the cleaning rotating body and the first transport means. Moreover, the information acquiring means may have input means for inputting the information on a thickness of the recording medium. Then, first driving means is further provided to drive the first and second transport means, the cleaning rotating body is a driven rotating body, and the control means may change the rotation velocity of the cleaning rotating body indirectly by controlling driving of the first driving means. Alternately, second driving means is further provided to drive the cleaning rotating body, and the control means may change the rotation velocity of the cleaning rotating body by controlling driving of the second driving means.

Moreover, to attain the above-mentioned object, a second aspect of the invention is a printer provided with a recording media transporting apparatus for transporting recording media, and the recording media transporting apparatus is characterized by having a configuration of the recording media transporting apparatus of the first aspect. Also in the printer of the second aspect, the printer has the recording media transporting apparatus of the first aspect, and therefore, exhibits the same action effect as in the first aspect.

According to the invention, the rotation velocity of the cleaning rotating body is controlled by the control means from the first rotation velocity to the second rotation velocity before the front end of the recording medium reaches the second transport means, it is thereby possible to prevent the recording medium from significantly rolling back due to the adhesive strength of the adhesive portion even when the adhesive strength is strong in the adhesive portion of the cleaning rotating body, and it is thus possible obtain the effect enabling the recording medium to be cleaned without undergoing the effect of the adhesive strength of the cleaning rotating body.

BRIEF DESCRIPTION OF THE DRAWINGS

FIG. 2 is a schematic cross-sectional view of the printer of the embodiment showing a state where a blank card before undergoing recording processing is carried in;

DETAILED DESCRIPTION OF THE PREFERRED EMBODIMENT

Referring to drawings, described below is an embodiment applied to a printer having the function of printing and recording text and images in a card, and the function of performing magnetic recording processing on a magnetic stripe portion of the card.

(Configuration)

<System Configuration>

Figure 8:
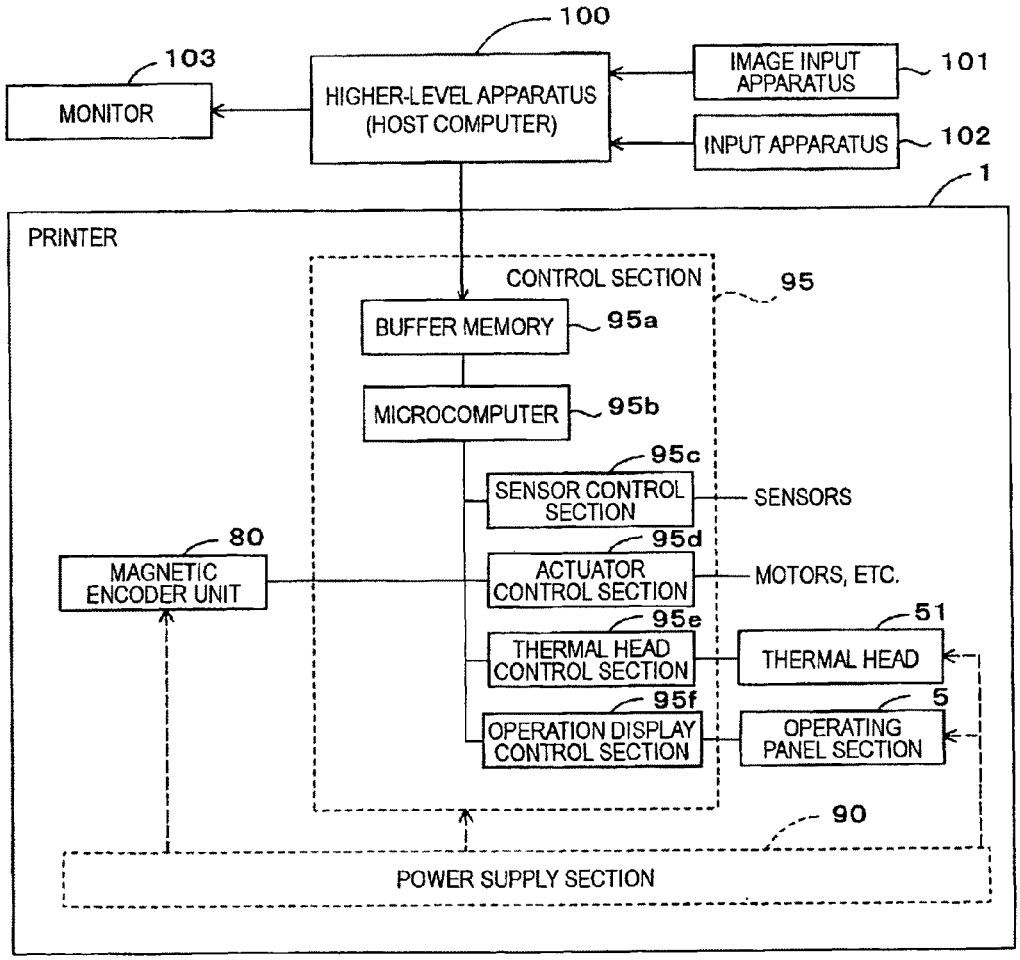
FIG. 8 is a block diagram showing a schematic configuration of a control section of the printer of the embodiment.
Figure 9:
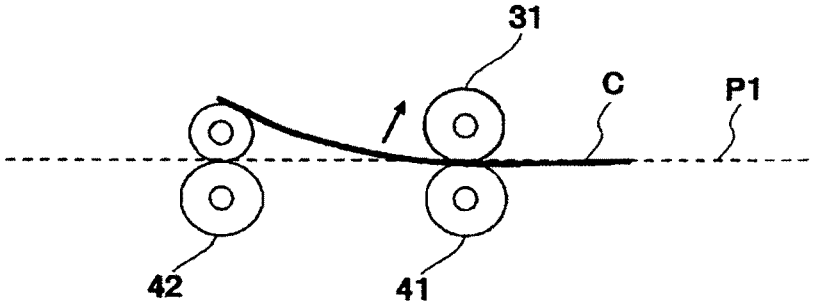
FIG. 9 is an explanatory view of a conventional card transporting apparatus having a cleaning roller and transport rollers.

As shown in FIG. 8, a printer 1 of this embodiment is connected to a higher-level apparatus 100 (for example, a host computer such as a personal computer) via an interface that is omitted in the figure, and the higher-level apparatus 100 transmits printing recording data, magnetic recording data, etc. to the printer 1, and is thereby able to provide instructions for the recording operation, etc. In addition, as described later, the printer 1 has an operating panel section 5 (operation display portion) (see FIG. 1), and it is thereby possible to provide recording operation instructions (input of thickness information of a card C described later) from the operating panel section 5, as well as recording operation instructions from the higher-level apparatus 100.

The higher-level apparatus 100 is generally connected to an image input apparatus 101 such as a scanner for reading an image recorded in an original document, an input apparatus 102 such as a keyboard and mouse to input a command and data to the higher-level apparatus 100, and a monitor 103 such as a liquid crystal display for displaying data and the like generated by the higher-level apparatus 100.

<External Configuration>

Figure 1:
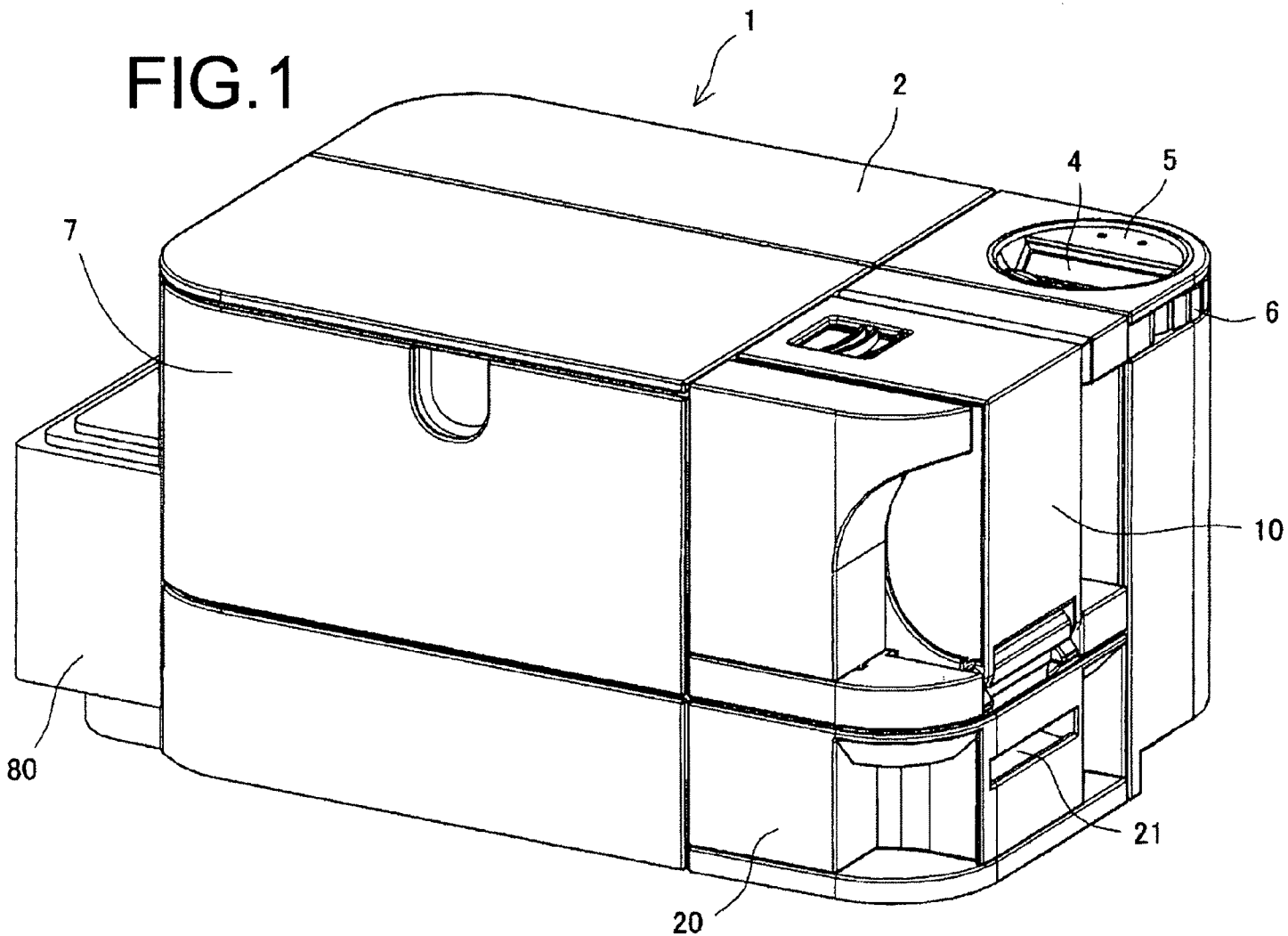
FIG. 1 is a perspective view of an appearance of a printer of an embodiment to which the invention is applicable.

As shown in FIG. 1, the printer 1 of this embodiment has a card supply section 10 which is disposed on one side of a casing 2, can accommodate a plurality of blank cards (about 100 sheets) before undergoing recording processing in a stacked manner, and is attached detachably to the casing 2, a card holding section 20 which is disposed under the card supply section 10 also on one side of the casing 2, can hold recording-processed cards (about 30 sheets) in an inclined manner, and is attached detachably to the casing 2, and a display section 4 for displaying the operating status including an error state of the printer 1, and is provided with the operating panel section 5 to perform various settings of printing processing and magnetic recording processing. In addition, the operating panel section 5 is provided rotatably in synchronization with rotation of a dial 6.

In a part of the card holding section 20 is provided a card release opening 21 formed as an opening portion enabling a recording-processed card that cannot be accommodated to be released outside the apparatus. Further, in a face of the printer 1 is provided an open/close cover 7 to access the inside of the apparatus in attaching/detaching a cartridge 52 having therein an ink ribbon R used in printing recording as described later, and the open/close cover 7 constitutes a part of the casing 2.

Then, on the other side of the casing 2 is disposed a magnetic encoder unit 80 opposed to the card supply section 10 or card holding section 20 where a part of the unit 80 protrudes from the casing 2.

<Internal Configuration>

Figure 2:
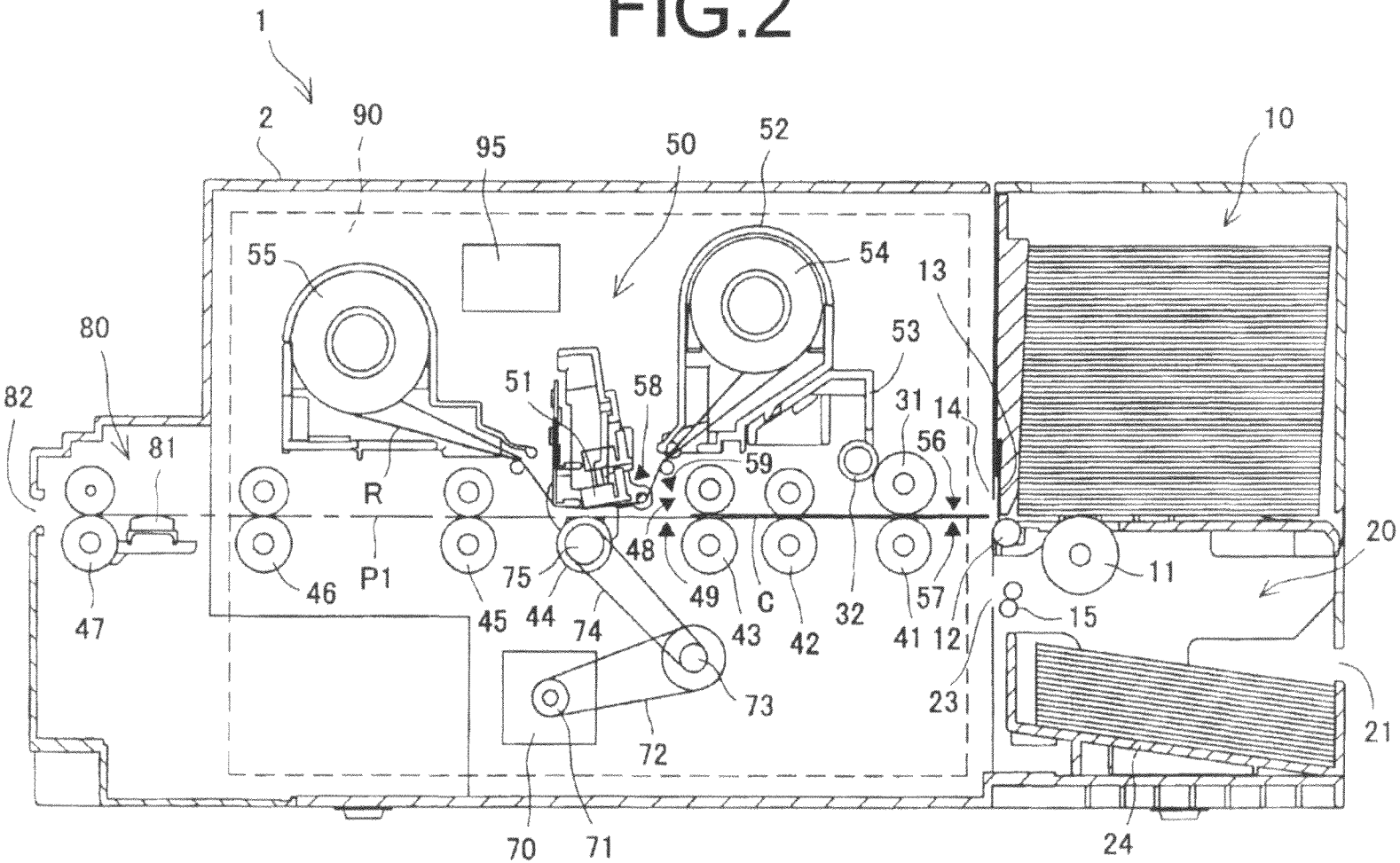

Each constituent component inside the printer 1 will be described below based on FIGS. 2 and 3. In addition, FIG. 2 shows a state where a blank card C before undergoing recording processing supplied from the card supply section 10 is transported toward a printing section 50, and a state where a cleaning roller 31 (driven roller) of a card cleaning mechanism 30 described later comes into contact with the surface of the card C under transport and cleans the surface to be printed.

Figure 3:
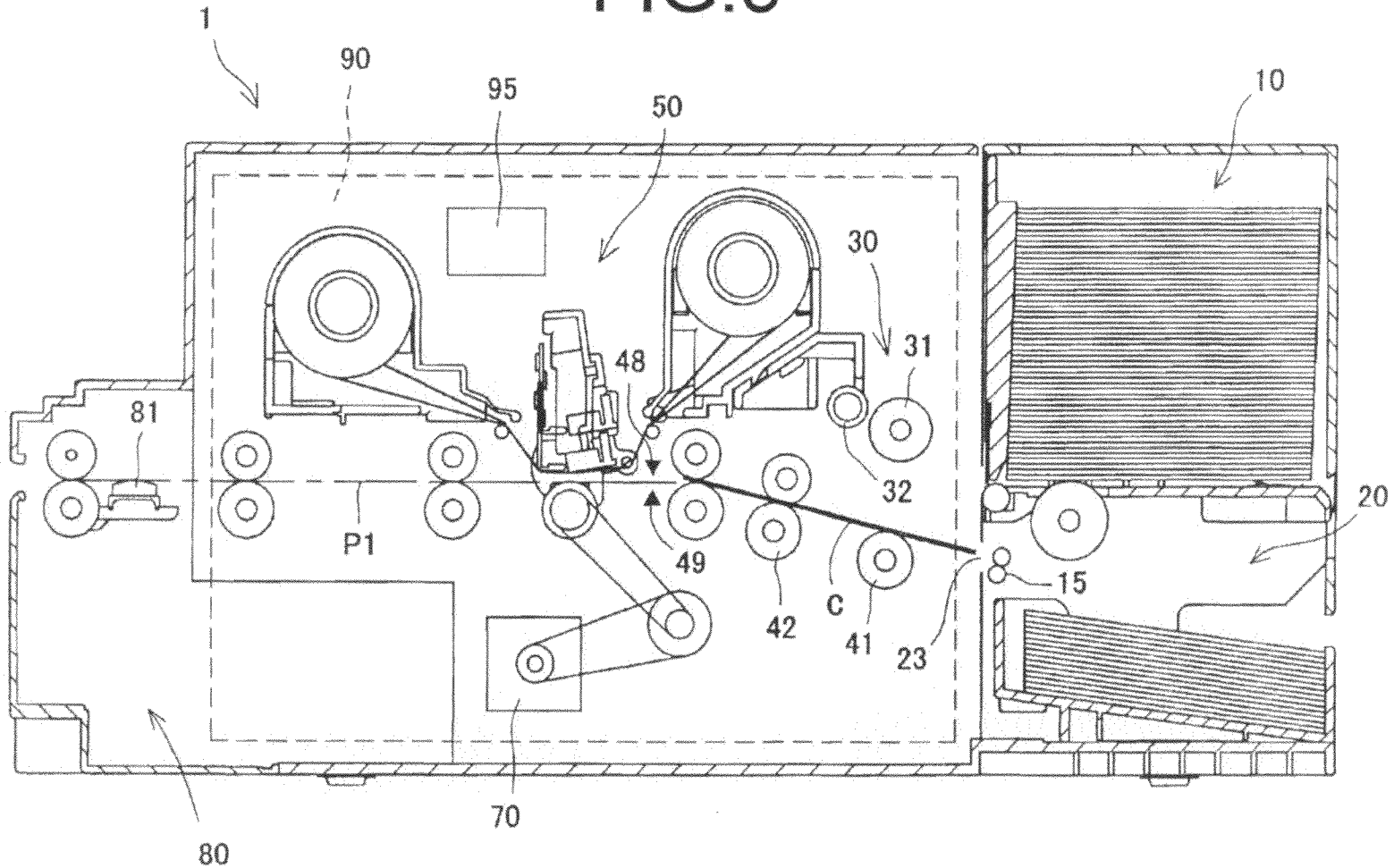
FIG. 3 is a schematic cross-sectional view of the printer of the embodiment showing a state where a card after undergoing the recording processing is discharged.

Further, FIG. 3 shows a state where the card C recording-processed in the printing section 50 or magnetic encoder unit 80 is discharged toward the card holding section 20. At this point, a transport roller 41 and transport roller 42 spaced apart from the transport roller 41 shift to a second position forming an inclined card transport path from a first position forming a substantially horizontal card transport path by a shift mechanism 60 described later, and maintain a state enabling the card C to be transported toward a card discharge opening 23.

The card supply section 10 is provided on one side of the printer 1 detachably, can accommodate a plurality of blank cards before undergoing recording processing in a stacked manner therein, and has a supply roller 12 and separate gate 13 formed of a plate-shaped member to allow only a single card C to pass through when a supply roller 11 that is driven to rotate by a motor, omitted in the figure, provided on the apparatus (printer 1) side feeds the lowermost (bottom layer) card to the inside of the apparatus. The supplied card C is passed between the supply roller 12 and separate gate 13, and guided to a card supply opening 14 provided on one side of the casing 2 to couple to the card supply section 10. In addition, more specifically, a flexible pad, not shown, is provided in a lower end portion of the separate gate 13, and enables separation on a sheet-by-sheet basis, for example, even in supplying thin cards with different thicknesses.

Meanwhile, the card holding section 20 is provided detachably under the card supply section 10 on one side of the printer 1 (casing 2), and can accommodate recording-processed cards in an inclined manner. The card holding section 20 is provided with a holding tray 24 with the inside bottom formed in an inclined-shape, and recorded cards C discharged from the card discharge opening 23 that is provided on one side of the casing 2 and that has an opening under the card supply opening 14 are discharged sequentially by a discharge roller 15 and held on the holding tray 24 (see FIG. 3).

The discharge roller 15 is fixedly installed on the printer 1 side, is driven to rotate by the above-mentioned motor that is omitted in the figure and that drives and rotates the supply roller 11, and when the direction in which the supply roller 11 rotates to supply a blank card C is assumed to be forward driving, is driven and rotated to discharge the discharged card C onto the holding tray 24 by reverse driving of the motor omitted in the figure. In other words, the supply roller 11 and discharge roller 15 are rotated by forward and reverse driving of the motor omitted in the figure, and the supply roller 11 is provided with a one-way clutch not shown, and is able to rotate only the card supply direction (due to the action of the one-way clutch, rotation driving is not conveyed in the opposite direction to the card supply direction). Meanwhile, the discharge roller 15 is driven to rotate in both directions by forward and reverse driving of the motor omitted in the figure. In this embodiment, the supply operation of a blank card C before undergoing recording processing is not performed concurrently with the discharge operation of a recording-processed card C, and any trouble does not occur when the discharge roller 15 rotates to discharge the card C and in the opposite direction.

The card C supplied from the card supply opening 14 is sequentially transferred to the transport rollers 41, 42 and 43 each rotating with a driving force conveyed from a transport driving motor 70 described later, and is transported along the substantially horizontal card transport path P1. In addition, each of the transport rollers 42 and 43 is comprised of a roller pair having a driving roller and driven roller (hereinafter, descriptions of the driven roller of the roller pair are omitted and only the driving roller is described unless particular differences are described).

On the side opposed to the transport roller 41, the cleaning roller 31 is provided to be able to move forward and backward with respect to the card transport path P1 so as to oppose the transport roller 41, constitutes a part of the card cleaning mechanism 30 described later, and has an adhesive portion on the circumference (surface) to clean (the surface of) the card C. When the cleaning roller 31 moves onto the card transport path P1 to come into contact with the transported card C (the state as shown in FIG. 2), the cleaning roller 31 nips the card C with the transport roller 41 having the driving force to rotate, and is thereby able to remove foreign substances such as dirt and dust from the print surface on which the printing section 50 prints and records.

Further, when the cleaning roller 31 moves onto the card transport path P1 that is the operating position, the cleaning roller 31 is positioned to come into surface-contact with a roller-shaped cleaner 32 disposed as a cleaner in a predetermined position spaced from the card transport path P1 that is a position adjacent to the cleaning roller 31. The roller-shaped cleaner 32 has an outside diameter (roller diameter) smaller than the outside diameter (roller diameter) of the cleaning roller, is secured to a support member 53 attached detachably to a predetermined portion of the cartridge 52, formed as a part of the printing section 50, internally having the ink ribbon R, and is provided rotatably.

In this embodiment, the cleaning roller 31 is comprised of a rotatable roller-shaped member such as a rubber material with the surface having adhesion. The roller-shaped cleaner 32 is wound by an adhesive tape having a sponge layer in a rotatable roller-shaped member made of resin. Since the adhesive tape has higher adhesion than adhesion of the surface of the cleaning roller 31, foreign substances such as dirt and dust which are removed from the card C and adhered to the surface of the cleaning roller 31 are transferred and delivered to the adhesive tape forming the surface of the roller-shaped cleaner 32 by surface-contact between the roller 31 and cleaner 32.

On the downstream side in the card transport direction of the transport roller 43 is provided the printing section 50 for printing and recording predetermined text and/or image on the surface of the card C cleaned by the cleaning roller.

In this embodiment, the printing section 50 adopts a configuration of the thermal transfer printer, and has a thermal head 51 provided to be able to move forward ad backward with respect to a platen roller 44 provided in a printing position on the card transport path P1. Between the platen roller 44 and thermal head 51 exists the ink ribbon R where a plurality of colors of Y (Yellow), M (Magenta), C (Cyan) and Bk (Black) ink layers is sequentially repeated in surface. The ink ribbon R is installed in the cartridge 52 as described previously.

In performing thermal-transfer recording of information such as text and image on the card C moving along the card transport path P1, the ink ribbon R is supplied from a ribbon supply reel 54, transported with almost all the surface being brought into contact with the front end portion of the thermal head 51, and wound around a ribbon winding reel 55 to wind the ink ribbon R. The ribbon supply reel 54 and ribbon winding reel 55 are driven and rotated by a motor not shown. At this point, by selectively operating a heating element of the thermal head 51 while pressing the thermal head 51 with the ink ribbon R existing on the surface of the card C, predetermined text and image is printed on the card C. In a transport path of the ink ribbon R are installed a plurality of guide shafts, and a transmission sensor comprised of a light-emitting device 58 and light-receiving device 59 for detecting the ink layer Bk (Black) to access a predetermined ink layer (ink layer Y in this embodiment).

On the upstream side (on the transport roller 43 side) in the card transport direction of the thermal head 51 is installed a transmission sensor (hereinafter, referred to as a card detecting sensor) comprised of a light-emitting device 48 and light-receiving device 49 for detecting a front end and rear end in the transport direction of the card C transported along the card transport path P1. Further, on the upstream side (on the supply roller 11 side) in the card transport direction of the cleaning roller 31 and transport roller 41 positioned in the first position is installed a transmission sensor (hereinafter, referred to an access sensor) comprised of a light-emitting device 56 and light-receiving device 57 for detecting the front end of the card C transported along the card transport path P1, respectively.

Under the printing section 50 is installed a transport driving motor 70 comprised of a forward-backward rotation driving-capable stepping motor for driving and rotating forward and backward a series of transport rollers 41, 42 and 43 as described previously and the platen roller 44. The rotation driving force by the transport driving motor 70 is conveyed to a pulley 73 by a belt 72 from a pulley 71 provided on the rotary shaft of the transport driving motor 70, and is conveyed to the platen roller 44 via a pulley 75 provided on the rotary shaft of the platen roller 44 by a belt 74 with one end wound around the pulley 73. In addition, the pulley 73 is comprised of a two-stage pulley, and belts 72 and 74 are extended in respective level difference portions.

A plurality of gears, omitted in the figure, is installed on the rotary shaft of the platen roller 44, on the rotary shafts of the transport rollers 41, 42 and 43, and between the rollers while being meshed with one another. The rotation driving force conveyed to the platen roller 44 is conveyed to each of the transport rollers 41, 42 and 43 via the plurality of gears.

Further, on the downstream side (on the ribbon winding reel 55 side) in the card transport direction of the platen roller 44 is provided a nip roller 45 which has the function of transporting the card C and nips the card C when the printing section 50 performs printing and recording on the card C. Furthermore, on the downstream side in the card transport direction of the nip roller 45 is provided a feed roller 46 to transport the card C, also along the card transport path P1.

The rotary shafts of the nip roller 45 and feed roller 46 are also provided with gears omitted in the figure, a plurality of gears omitted in the figure is also provided between the platen roller 44 and nip roller 45, and between nip roller 45 and feed roller 46, and by the plurality of gears meshing with one another, the rotation driving force from the transport driving motor 70 is branched from the gear provided on the rotary shaft of the platen roller 44 to the nip roller 45 and feed roller 46 via a driving force transmission mechanism containing the above-mentioned pulleys and gears, and a plurality of gears not shown. In addition, the nip roller 45 and feed roller 46 are configured to hold the card C in a halt state when the magnetic encoder unit 80 performs magnetic recording processing on a magnetic stripe portion provided on the backside of the print surface of the card C.

On the downstream side in the card transport direction of the printing section 50 is provided the magnetic encoder unit 80 adjacent to the feed roller 46. The magnetic encoder unit 80 is provided with a magnetic head 82 reciprocating (self-running) to scan along the card transport path P1 so as to perform magnetic recording processing on the magnetic stripe portion of the card C that is halted and held while being picked by the nip roller 45 and feed roller 46. In addition, the magnetic encoder unit 80 has a microcomputer (not shown) for controlling the magnetic recording processing of the magnetic head 81.

In a part of the magnetic encoder unit 80 is provided a card carrying-out opening 82 formed as an opening enabling the card C transported along the card transport path P1 to be discharged outside the apparatus. In other words, the card carrying-out opening 82 is opposed to the card supply opening 14, and is provided on an extended line of the card transport path P1 on the other side of the casing 2.

Then, inside the magnetic encoder unit 80 is installed a carrying-out roller 47 for transporting the card C toward the card carrying-out opening 82, while being capable of carrying the card C out of the card carrying-out opening 82. Although the magnetic encoder unit 80 is not provided with a driving source for driving and rotating the carrying-out roller 47, a plurality of gears not shown is provided and coupled between the transport roller 47 and feed roller 46, and the rotation driving force conveyed to the feed roller 46 is thereby transferred to the carrying-out roller 47.

Accordingly, the printer 1 has a configuration that the card supply opening 14, printing section 50 and magnetic encoder unit 80 are provided along the substantially horizontal card transport path P1 extended from the card supply section 10.

Further, as can be seen from the figure, the magnetic encoder unit 80 has a unit shape such that a part of the unit is inserted in the inside of the apparatus, and the transport driving motor 70 is provided, under the printing section 50, between the magnetic encoder unit 80 and a shift mechanism 60 (see FIGS. 4 to 7) for shifting the transport rollers 41 and 42 between the first position and the second position, described later. In addition, in this example, space is formed between the cleaning roller 31 and the driven roller (that is the roller disposed on the same side as the cleaning roller 31 via the card transport path P1) side of the transport roller 42, and a guide member or the like is not installed which prevents, from above, the transported card from rolling back, while guiding the card C.

Figure 4:
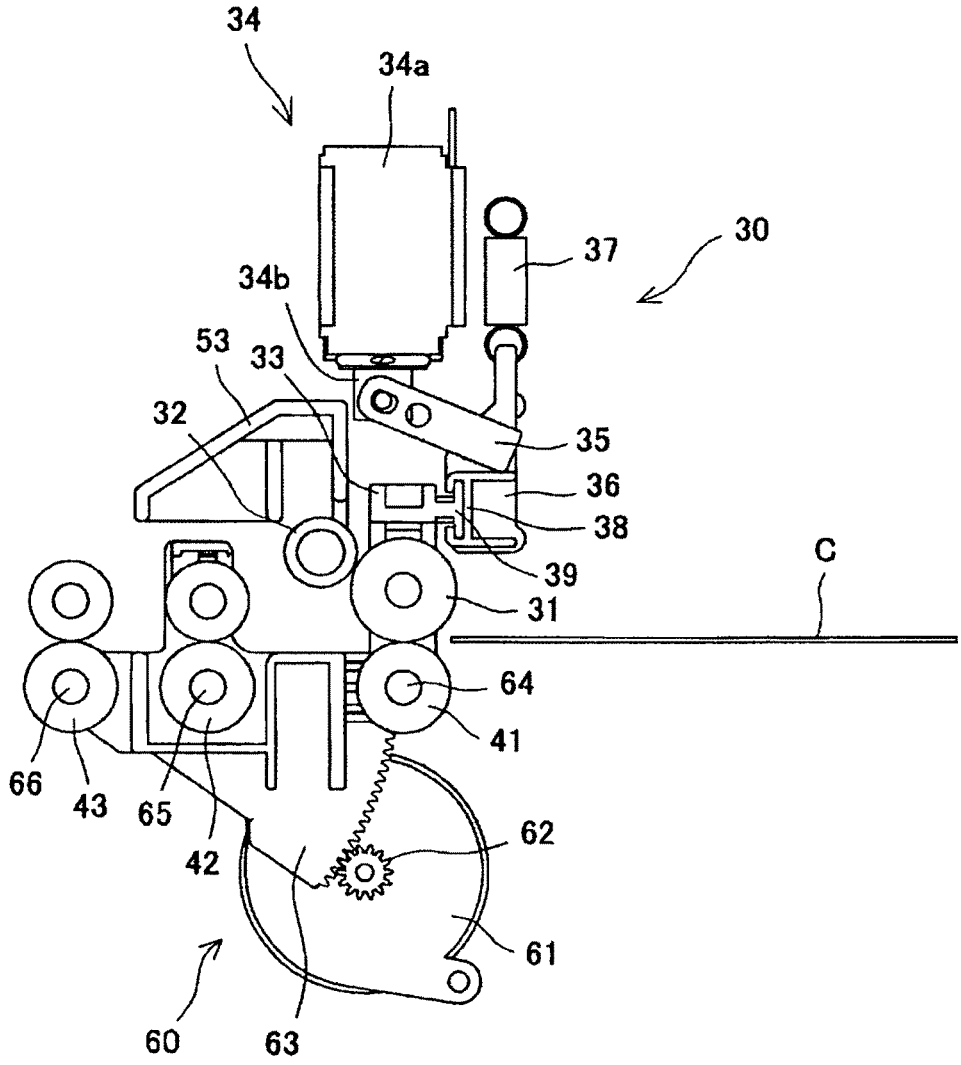
FIG. 4 is a partially enlarged view to explain the operation of a shift mechanism of a transport roller and card cleaning mechanism, and shows a state before the cleaning roller and transport roller receive a card.
Figure 5:
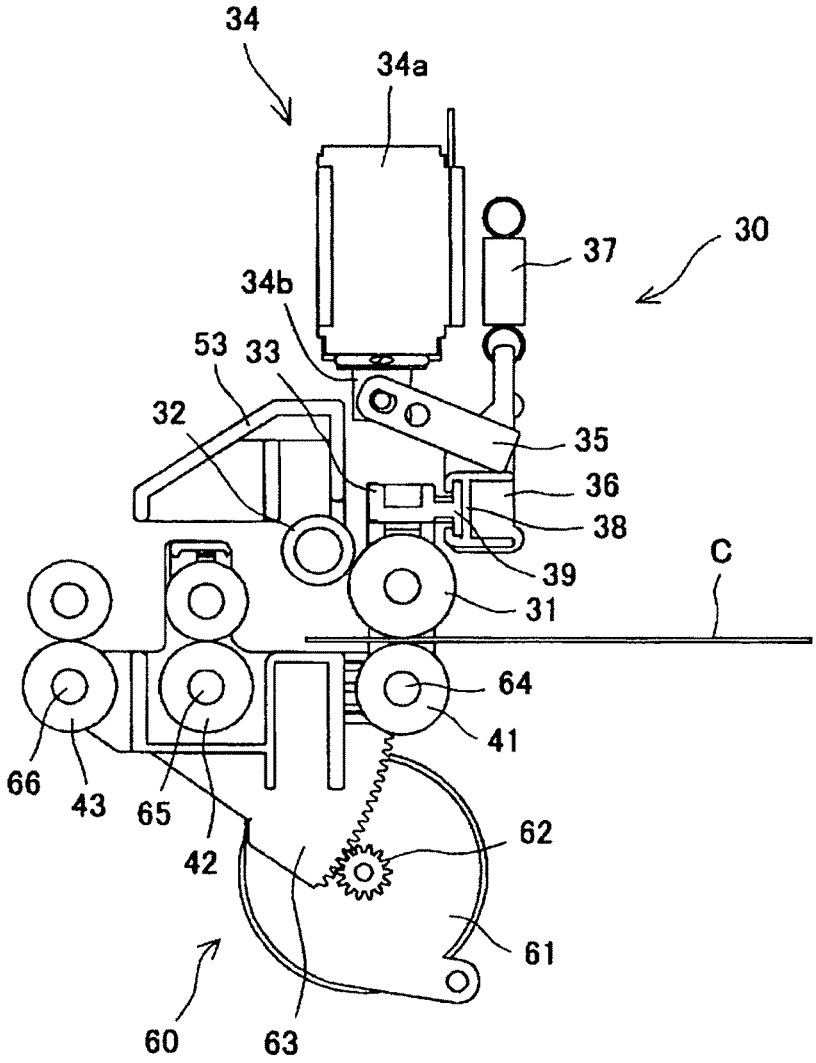
FIG. 5 is another partially enlarged view to explain the operation of the shift mechanism of the transport roller and card cleaning mechanism, and schematically shows a position in which the cleaning roller and transport roller receive the card where the position is a branching point of whether the rotation velocity of the transport roller opposed to the cleaning roller is reduced or maintained.
Figure 6:
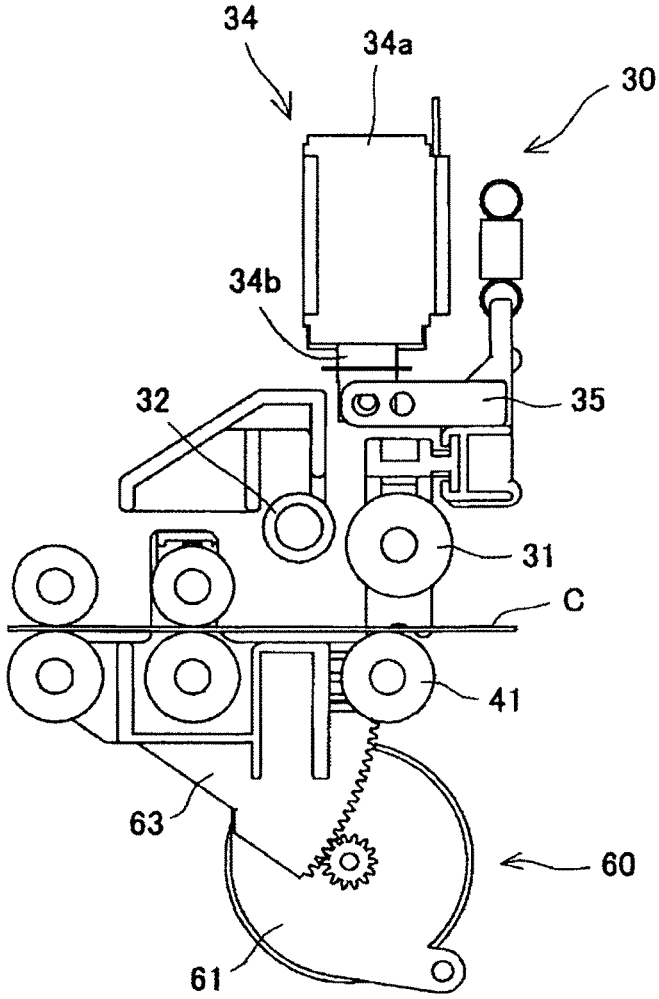
FIG. 6 is still another partially enlarged view to explain the operation of the shift mechanism of the transport roller and card cleaning mechanism, and shows a state where the card is transported inversely in performing multicolor surface-successive printing.
Figure 7:
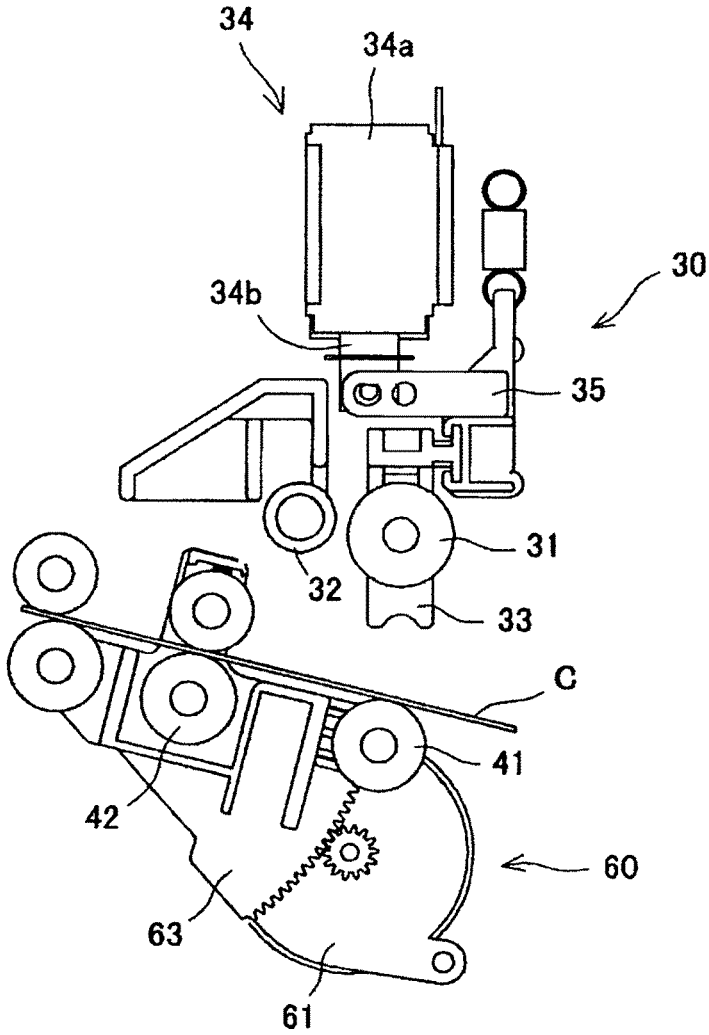
FIG. 7 is still another partially enlarged view to explain the operation of the shift mechanism of the transport roller and card cleaning mechanism, and shows a state where the recording-processed card is discharged.

The card cleaning mechanism 30 and shift mechanism 60 will specifically be described below with reference to FIGS. 4 to 7. In addition, FIG. 4 shows a state immediately before the cleaning roller 31 and transport roller 41 nip the card C therebetween after the card C is received from the card supply opening 14, FIG. 5 shows a state before the card C reaches the transport roller 42 after the cleaning roller 31 and transport roller 41 receive (nip) the card C, FIG. 6 shows a state where the card C is inversely transported toward the card supply opening 14 when the printing section 50 performs multicolor surface-successive printing recording on the print surface of the card C, and further, FIG. 7 shows a state where the recording-processed card C is transported toward the card discharge opening 23.

<Card Cleaning Mechanism>

The card cleaning mechanism 30 has an actuator 34 comprised of a solenoid 34*a* and plunger 34*b* that moves forward and backward by driving switching (ON/OFF) of the solenoid 34*a* so as to configure the cleaning roller 31 to be able to move between an operating position where the roller 31 gets to the card transport path P1 and is able to come into contact (surface-contact) with the card C and the roller-shaped cleaner 32, and a retract position that is a home position spaced apart from the card transport path P1.

At the end portion of the plunger 34*b* is provided a lever member 35 with its one end portion rotatably attached thereto, and an engagement member 36, etc. are further provided to engage in the other end portion of the lever member 35. The engagement member 36 is hooked to a pulling spring 37 with its one end side fixed to a predetermined position inside the apparatus, and is biased upward always by biasing force of the pulling spring 37.

Further, the card cleaning mechanism 30 has a holder 33 that holds the cleaning roller 31, and has a configuration that a convex-shaped portion 39 formed in part of the holder 33 is inserted in a concave-shaped portion 38 formed in part of the engagement member 36 to be integrated. In other words, the holder 33 holding the cleaning roller 31 is provided detachably with respect to the engagement member 36. Further, the card cleaning mechanism 30 has a configuration including the roller-shaped cleaner 32 fixed rotatably to the support member 53 attached detachably to a predetermined portion of the cartridge 52, internally provided with the ink ribbon R, formed as a part of the printing section 50.

In addition, when the solenoid 34*b* of a driving section 34 is driven (driving ON), the lever-member 35 presses down the engagement member 36 to indirectly press the holder 33 holding the cleaning roller 31 to be pressed down, and the cleaning roller 31 is thereby positioned in the above-mentioned operating position.

<Shift Mechanism>

As shown in FIGS. 4 to 7, the shift mechanism 60 has a stepping motor 61 capable of rotating forward and backward, a motor gear 62 provided on a rotary shaft of the stepping motor 61, a bracket 63 with a gear having a gear portion meshing with the motor gear 62, etc. Further, the roller shafts 64, 65 and 66 supporting the transport rollers 41, 42 and 43 are held by the bracket 63 with the gear.

Since the bracket 63 with the gear is attached rotatably around the roller shaft 66 of the transport roller 43, by the bracket 63 with the gear rotating by forward/backward rotation driving of the stepping motor 61, the shift mechanism 60 is configured to enable the transport rollers 41 and 42 to travel between the first position (that is a home position in which the transport rollers 41 and 42 form the substantially horizontal card transport path, see FIGS. 4 and 6) and the second position (that is a position in which the transport rollers 41 and 42 form the inclined card transport path, see FIG. 7).

Described next is control and an electrical system of the printer 1. As shown in FIGS. 2 and 3, the printer 1 has a control section 95 that performs operation control of the entire printer 1, and a power supply section 90 that converts utility AC power into DC power capable of driving/operating each mechanism section, control section, etc.

<Control Section>

As shown in FIG. 8, the control section 95 has a microcomputer 95*b* (hereinafter, abbreviated as micon 95*b*) that performs the entire control processing of the printer 1. The micon 95*b* is comprised of a CPU operating on a high-speed clock as a central processing unit, ROM storing basic control operation (programs and program data such as reference information to compare the thickness of a card as described later) of the printer 1, RAM acting as a work area of the CPU, and an internal bus connecting the aforementioned components.

The micon 95*b* is connected to an external bus. The external bus is connected to an interface, omitted in the figure, to perform communications with the higher-level apparatus 100, and to a buffer memory 95*a* to temporarily store printing recording data to print on the card C, magnetic recording data to magnetically record in the magnetic stripe portion of the card C, etc.

Further, the external bus is connected to a sensor control section 95*c* that controls signals from various kinds of sensors, an actuator control section 95*d* that controls motor drivers, etc. for outputting the driving pulse and driving power to each motor, a thermal head control section 95*e* that controls thermal energy of the thermal head 51, an operation display control section 95*f* to control the operating panel section 5 and the magnetic encoder unit 80. The sensor control section 95*c* is connected to the card detecting sensor comprised of the light-emitting device 48 and light-receiving device 49, the access sensor comprised of the light-emitting device 56 and light-receiving device 57, and other sensors omitted in the figure. The actuator control section 95*d* is connected to the stepping motor 61, transport driving motor 70, other motors not shown, the actuator 34, etc. The thermal head control section 95*e* is connected to the thermal head 51, and the operation display control section 95*f* is connected to the operating panel section 5.

In addition, the power supply section 90 supplies operation/driving power to the control section 95, thermal head 51, operating panel section 5 and magnetic encoder unit 80 (see FIG. 8).

<Operation>

The operation of the printer 1 of this embodiment will be described below mainly on the CPU (hereinafter, simply referred to as a CPU) of the micon 95*b*.

When the power is supplied to the control section 95, the CPU reads the program and program data stored in the ROM (extends in the RAM), and performs initial processing to actuate each mechanism section. In other words, in the initial processing, the CPU confirms connection with each of control sections 95*a* and 95*c* to 95*f* such as the sensor control section 95*c* constituting the control section 95 connected to the micon 95*b* via the external bus and with the magnetic encoder unit 80, then determines whether each constituent section is located in the above-mentioned home position (see FIGS. 2 and 4) based on a signal from the sensor control section 95*c* and the like, and when each constituent section is not located in the home position, shifts the section to the home position. Based on the signal from the sensor control section 95*c* and the like, when each constituent component does not move to the home position even after repeating the return operation to the home position, the CPU notifies the higher-level apparatus 100, while displaying the matter in the display section 4 via the operation display control section 95*f*. Further, in the initial processing, based on the signal from the sensor control section 95*c* and the like, the CPU also determines whether cards are held in the card supply section 10. When the CPU determines that cards are not held, the CPU notifies the higher-level apparatus 100, while displaying the matter in the display section 4, and waits for cards to be held in the card supply section 10.

Meanwhile, a printer driver installed in the higher-level apparatus 100 determines various parameter values to control the recording operation in the printer 1 based on a recording command designated by an operator (user), generates printing recording data and magnetic recording data to perform recording on the card from the recording command, and transmits the data to the printer 1. The buffer memory 95*a* of the control section 95 stores the various parameter values that are of a recording control command, image data and/or text data obtained by decomposing the printing recording data into color components of Y, M, C and Bk, and the magnetic recording data. In addition, in this embodiment, the higher-level apparatus 100 side decomposes into color components (the original data is R,G,B), and the printer 1 converts R,G,B into Y,M,C to use as the image data, and uses Bk data extracted on the higher-level apparatus 100 side also as the Bk data for text data. Further, the higher-level apparatus 100 requests the operator for thickness information of the card C, and when the operator completes input of the thickness information (for example, information that the thickness of the card C is 0.8 mm) of the card C via the input apparatus 102, transmits also the input thickness information to the micon 95*b* as part of the recording control command.

The CPU retrieves the recording control command (various parameter values) stored in the buffer memory 95*a*, and according to these parameter values and the program and program data extended in the RAM, controls each mechanism section as described below.

Figure 11:
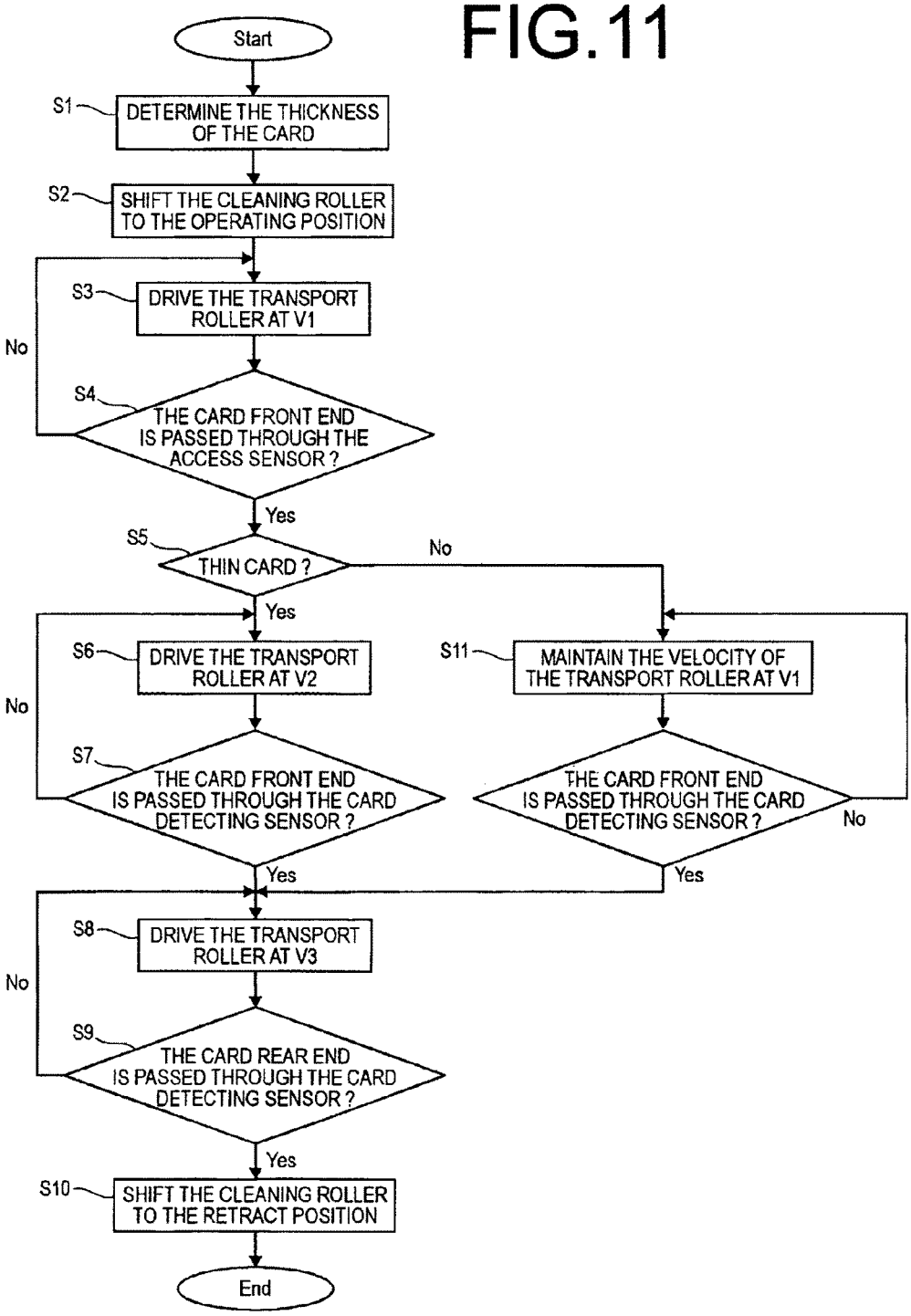
FIG. 11 is a flowchart to explain the flow of the card supply operation of the embodiment.

Herein, the supply operation of the card C is described with reference to FIG. 11. First, the CPU determines whether or not the thickness of the captured card C is thinner than the reference information (beforehand set predetermined thickness, for example, 1 mm) to compare the card thickness (this determination is referred to as a thin determination for convenience in description) (S1). According to the above-motioned example, the thickness of the card C is 0.8 mm and is thinner than the beforehand set predetermined thickness of 1 mm, and a negative determination is made. Next, the CPU drives the actuator 34 (solenoid 34*a*) (ON state) via the actuator control section 95*d*, shifts the cleaning roller 31 to the operating position as shown in FIG. 4 from the retract position (home position) as shown in FIG. 6, and makes preparations for receiving the card C (S2). At this point, the shift mechanism 60 locates the transport rollers 41 and 42 in the first position (home position) so as to form the substantially horizontal card transport path (the state as shown in FIGS. 2 and 4).

Next, the CPU actuates the transport driving motor 70 via the actuator control section 95*d* to drive each roller installed on the card transport path P1 via the driving transmission mechanism, and drives the motor omitted in the figure to drive and rotate the supply roller 11 via the actuator control section 95*d*. At this point, in this example, the transport rollers 41 to 43 rotate at a rotation velocity V1 (for example, the number of revolutions corresponding to the velocity for transporting the card at 160 mm/s) (S3). By this means, the lowermost card C in the card supply section 10 is carried inside the casing 2 via between the supply roller 12 and separate gate 13 and the card supply opening 14 (see FIG. 4).

The CPU is able to grasp that the card C is transported to the inside of the casing 2 by monitoring an output of the access sensor comprised of the light-emitting device 56 and light-receiving device 57. When the front end in the transport direction of the card C reaches the position of the access sensor (S4) and the determination result of beforehand made thickness determination is positive (S5), the CPU controls the actuator control section 95*d* (output of the driving pulse in the section 95*d*), and gradually (for example, to make a decrease in driving pulse per unit time constant) changes the rotation velocity V1 of the transport rollers 41 to 43 to the rotation velocity V2 (for example, the number of revolutions corresponding to the velocity for transporting the card at 50 mm/s) that is lower than V1 (S6). By this means, the front end of the card C is reduced in the velocity gradually from the position of the access sensor comprised of the light-emitting device 56 and light-receiving device 57, and is transported a predetermined distance (for example, 40 mm) (the state of FIG. 5). Meanwhile, when the determination result of beforehand made thickness determination is negative (S5), the CPU maintains V1 without reducing the rotation velocity of the transport rollers 41 to 43 to V2 (S11). The card C is held between the transport rollers 41 and 41, while the print surface is cleaned by the cleaning roller 31, and is transported toward the card carrying-out opening 82 side along the card transport path P1.

The CPU monitors an output of the card detecting sensor comprised of the light-emitting device 48 and light-receiving device 49, and when the front end of the card C reaches the position of the card detecting sensor (S7), in order to enhance the transport function, controls the actuator control section 95*d* to gradually change the rotation velocity of the transport rollers 41 to 43 to a rotation velocity V3 (for example, the number of revolutions corresponding to the velocity for transporting the card at 200 mm/s) that is higher than V1 and V2 (S8). In addition, when the rear end of the card C is detected by the card detecting sensor (S9), using the card rear end detection as a trigger, the CPU halts the driving of the actuator (solenoid 34*a*) (OFF state). By this means, the cleaning roller 31 is released from the pressing operation caused by the lever member 35, and shifts to the retract position that is the home position as shown in FIG. 6 from the operating position as shown in FIG. 4 (S10).

The card C is further transported toward the card discharge opening 82 on the card transport path P1 (200 mm/s in this example) up to a position where the opposite end portions are picked by the feed roller 46 and nip roller 45, by the driving force of the transport driving motor 70. When the number of pulses of the transport driving motor 70 reaches a predetermine number after the card rear end is detected by the cared detecting sensor, the CPU halts the driving of the transport driving motor 70. By this means, the card C is halted and held while being picked in opposite end portions by the transport roller 47 and nip roller 45, and becomes a state enabling the magnetic head 81 of the magnetic encoder unit 80 to write the magnetic recording data in the magnetic stripe portion.

For the period (during which the card detecting sensor detects the card rear end, and the opposite end portions of the card C are picked by the feed roller 46 and nip roller 45), the CPU outputs the magnetic recording data stored in the buffer memory 95*a* to (a microcomputer of) the magnetic encoder unit 80 via the external bus, and when the number of pulses of the transport driving motor 70 reaches the predetermined number as described above (when the opposite end portions of the card C are picked by the transport roller 47 and nip roller 45), instructs (the microcomputer of) the magnetic encoder unit 80 to write the magnetic recording data.

According to the instruction, the microcomputer of the magnetic encoder unit 80 functions as a slave computer of the CPU, causes the magnetic head 81 to run from the transport roller 47 side to nip roller 45 side to write the received magnetic recording data in the magnetic stripe portion of the card C, further causes the magnetic head 81 to run in the opposite direction of from the nip roller 45 side to transport roller 47 side to verify (check whether the data is properly written) the written magnetic recording data, and notifies the CPU of the verified result.

When the verified result indicates faulty write, the CPU notifies the higher-level apparatus 100, while indicating the matter in the display section 4, and waits for an instruction for carrying out the card C to the outside of the apparatus from the higher-level apparatus 100 or operating panel section 5. When the carrying-out instruction is received, the CPU drives the transport driving motor 70 by the predetermined number of pulses (forward rotation) to carry out the card C to the outside of the apparatus via the card carrying-out opening 82, receives supply of a new card C from the card supply section 10, and as in the foregoing, causes the magnetic encoder unit 80 to write and verify the magnetic recording data in the magnetic stripe portion of the (new) card C.

Meanwhile, when the verified result from the microcomputer of the magnetic encoder unit 80 does not have any problem (no faulty write of the magnetic recording data in the magnetic stripe portion in the card C), the CPU drives the transport driving motor 70 backward, and transports backward the card C halted and held with its opposite end portions picked by the nip roller 45 and feed roller 46 to the card supply opening 14 side along the card transport path P1. During the backward transport, when the rear end of the card C is detected by the transmission sensor comprised of the light-emitting sensor 48 and light-receiving sensor 49, the CPU further maintains the backward driving of the transport driving motor 70 by the predetermined number of pulses, and halts the driving of the transport driving motor 70. By this means, the card C is halted and held, while the rear half portion in the transport direction is picked by the transport rollers 42 and 43 and the front-end portion in the transport direction is supported by the transport roller 41 (see FIG. 6).

During this period, the CPU drives the motor not shown, winds the ink ribbon R of the cartridge 52 around the ribbon winding reel 55 side, and using the time the transmission sensor comprised of the light-emitting device 58 and light-receiving device 59 detects the end portion of the ink layer Bk (Black) (the time the light-receiving device 59 detects that emitted light of the light-emitting device 58 becomes a transmitted state from a non-transmitted state by the ink layer Bk) as a trigger, further drives the motor not shown by the predetermined number of steps to access the ink ribbon R so that the front end portion of the ink layer Y (Yellow) is located in the position between the thermal head 51 and platen roller 44.

Next, the CPU drives the transport driving motor 70 to rotate forward, thereby transports the card C toward the card carrying-out opening 82 side on the card transport path P1, checks the front-end position of the card C using the card detecting sensor comprised of the light-emitting device 48 and light-receiving device 49, and prints intended text and image of the printing recording data on the surface of the card C using the printing section 50. In other words, the CPU actuates a heating element of the thermal head 51 selectively according to the image data of Y color (image data such that Y component is color-converted from the RGB data), while pressing the thermal head 51 with the ink ribbon R (portion of the ink layer Y) existing on the surface of the card C. By this means, to the surface of the card C is directly transferred a thermal transfer ink component of Y (Yellow) applied to the ink ribbon R.

At this point, the platen roller 44 supports the backside of the card C. The card C is first picked and transported by the transport rollers 42 and 43, is transported while being nipped in the front end portion side by the nip roller 45 and in the rear end portion side by the transport roller 43 as the card C is transported toward the card carrying-out opening 82 side on the card transport path P1, and finally, is nipped and transported by the nip roller 45 (while the backside of the rear end portion side is supported by the platen roller 44). Accordingly, the transport rollers 42 and 43 and nip roller 45 function as a capstan roller for transporting the card C at a constant speed while nipping when the printing section 50 performs printing recording. The CPU checks the rear end position of the card C using the card detecting sensor comprised of the light-emitting device 48 and light-receiving device 49, further maintains the forward-rotation driving of the transport driving motor 70 by the predetermined number of pulses, and halts the driving of the transport driving motor 70.

Next, the CPU drives the transport driving motor 70 to rotate backward, transports the card C backward to the card supply opening 14 side along the card transport path P1, and when the card C is halted and held while the rear half portion in the transport direction is picked by the transport rollers 42 and 43 and the front half portion in the transport direction is supported by the transport roller 41, halts the driving of the transport driving motor 70 (see FIG. 6). During this period, the CPU drives the motor not shown, winds slightly the ink ribbon R of the cartridge 52 to the ribbon winding reel 55*b* side, and locates the front end portion of the ink layer M (Magenta) in the position between the thermal head 51 and platen roller 44. Next, the CPU drives the transport driving motor 70 to rotate forward, and transports the card C toward the card carrying-out opening 82 on the card transport path P1, while transferring directly a thermal transfer ink component of M (Magenta) applied to the ink ribbon R to the surface of the card C using the printing section 50. Thereafter, in the same way, the CPU directly transfers thermal transfer ink components of C (Cyan) and Bk (Black) applied to the ink ribbon R to the surface of the card C using the printing section 50. By this means, a color image due to Y, M, C and Bk is formed on the surface of the card C.

Then, the CPU transports the card C toward the card discharge opening 23. In other words, the CPU drives the transport driving motor 70 to rotate backward, and transports the card C backward toward the card supply opening 14 side along the card transport path P1. As shown in FIGS. 4 and 6, when the printing section 50 performs multicolor surface-successive printing recording on the print surface of the card C, in transporting backward the card C to the card supply opening 14 side (the state as shown in FIG. 6), the transport rollers 41 and 42 are maintained in the first position in which the rollers are positioned to form the substantially horizontal card transport path. In discharging the card C subjected to the predetermined recording processing toward the card discharge opening 23, the CPU controls driving of the stepping motor 61 at the time the card detecting sensor comprised of the light-emitting device 48 and light-receiving device 49 detects the rear end of the card C that is transported backward on the card transport path P1, or the time a few pulses have elapsed since the rear end of the card is detected as a trigger, and shifts the transport rollers 41 and 42 to the second position in which the rollers are positioned to form the inclined card transport path by the shift mechanism 60 (driving of the stepping motor 61) (the state as shown in FIGS. 3 and 7), while driving backward the motor, omitted in the figure, for driving and rotating the supply roller 11 as described above to drive and rotate the discharge roller 15.

By this means, the card C is held in the card holding section 20 via the card discharge opening 23, or (when the card holding section 20 is filled with cards), is released to the outside from the card release opening 21. In addition, even at the card discharge time as shown in FIG. 7, the cleaning roller 31 is positioned in the retract position that is the home position spaced apart from the card transport path P1 as in the state shown in FIG. 6.

At the time the card is held in the card holding section 20 or released from the card release opening 21, the CPU halts the backward-rotation driving of the transport driving motor 70 and the motor omitted in the figure. In addition, the CPU drives again (rotation driving in the reverse direction) the stepping motor 61 at predetermined timing after the operation of discharging the card C to the card holding section 20 is completed, and returns the transport rollers 41 and 42 from the second position in which the rollers are positioned to form the inclined card transport path to the first position in which the rollers are positioned to form the substantially horizontal card transport path. By this means, the recording processing on the card C is finished, and when a next job is present, the aforementioned operation is repeated.

(Effects, etc.)

The effects and others of the printer 1 of this embodiment will be described below.

In the printer 1 of this embodiment, the CPU receives the thickness information of the card C from the higher-level apparatus 100, determines whether or not the thickness of the card C is thinner than the reference information (beforehand set predetermined thickness), and when the thickness of the card C is thinner than the reference information, controls the rotation velocity of the cleaning roller 31 to reduce from the rotation velocity V1 to rotation velocity V2 for a period during which the front end of the card C reaches the transport roller 42 from the cleaning roller 31. Therefore, since it is possible to prevent warpage due to the adhesive strength of the adhesive portion in the cleaning roller 31 from increasing, it is possible to ensure the print quality in the printing section 50 and stability in writing in the card C in the magnetic encoder unit 80, and it is also possible to suppress a jam caused by the card C running on the transport roller 42 (the driven roller side). Meanwhile, in the case where the thickness of the card C is thicker than the reference information, even when the rotation velocity V1 is kept, the effect of warpage due to the adhesive strength of the adhesive portion in the cleaning roller 31 is small, it is possible to ensure the print quality in the printing section 50 and stability in writing in the card C, the card C neither runs on the transport roller 42 nor causes a jam, and it is thus desirable to enhance transport efficiency of the card C (maintain the rotation velocity of the cleaning roller 31 at V1).

Further, in the printer 1 of this embodiment, it is possible to use the cleaning roller 31 having the adhesive portion with high adhesive strength. Therefore, in the printer 1, the effect of dirt and dust on the print quality can be eliminated in the printing section 50, and it is thereby possible to obtain cards with high print quality.

Furthermore, in the printer 1 of this embodiment, space is formed between the cleaning roller 31 and the driven roller side of the transport roller 42, and a guide member or the like to prevent the card C from warping, etc. is not installed. Therefore, the printer 1 eliminates deterioration in the print quality which would occur when the cleaned surface of the card C is struck by the guide and the card C becomes dirty.

Figure 10:
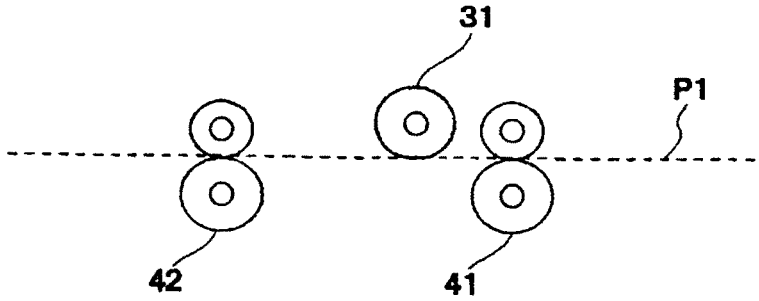
FIG. 10 is an explanatory view showing a position relationship between the cleaning roller and transport rollers in a card transporting apparatus of a printer of another embodiment to which the invention is applicable.

Still furthermore, the printer 1 of this embodiment adopts the configuration where the cleaning roller 31 and transport roller 41 are arranged opposite to each other, and a card C is nipped between the cleaning roller 31 that is a driven roller and the transport roller 41 that is a driving roller. Therefore, in the printer 1, it is possible to apply the force in the opposite direction to warping of the card C by the rotation force of the transport roller 41, and it is possible to promote prevention of the card C from warping. In addition, the opposite arrangement is not limited to the aspect of this embodiment, and for example, as shown in FIG. 10, the cleaning roller 31 may be disposed in a position misaligned from the transport roller 41.

Moreover, in the printer 1 of this embodiment, in changing the rotation velocities of the transport rollers 41 to 43, since the rotation velocities are changed gradually, the effect exerted on the surface of the card C is small, and it is possible to prevent the surface of the card C from getting rough.

In addition, this embodiment shows the example where the CPU receives the thickness information of the card C from the higher-level apparatus 100, and determines whether or not the thickness of the card C is thinner than the reference information, but the invention is not limited thereto. In other words, without determining whether or not the thickness of the card C is thinner than the reference information, when the front end of the card C is transported a predetermined distance from the position of the access sensor comprised of the light-emitting device 56 and light-receiving device 57 (the state of FIG. 5), the rotation velocity of the cleaning roller 31 (transport roller 41) may be reduced always to V2. In this way, the transport efficiency deteriorates when the card C is thick, but complicated control is avoided, and it is possible to prevent the occurrence of warpage and jam irrespective of the thickness of the card C.

Further, this embodiment shows the example where the micon 95*b* acquires the thickness information of the card C input from the higher-level apparatus 100, but the invention is not limited thereto, and for example, the micon 95*b* may acquire the thickness information of the card C input from the operating panel section 5. Furthermore, the printer 1 may have a detecting section for detecting a thickness of the card C so as to obtain the thickness information of the card from a detection result of the detecting section. As such a detecting section, it is possible to use a contact type as described in Patent Document 2 and non-contact type.

Moreover, this embodiment shows the example where the micon 95*b* acquires the thickness information of the card C input from the higher-level apparatus 100 and compares with the reference information that is stored in the ROM and extended in the RAM, and as a substitute for such comparison, the CPU may acquire information (information on the thickness of the card C) indicating that the thickness of the card C is thinner or thicker (or the same as) than the reference information from the higher-level apparatus 100 or the operating panel section 5, and according to the information, maintain the rotation velocity V1 of the cleaning roller 31 or reduce to the rotation velocity V2.

Further, this embodiment shows the example where the cleaning roller 31 is a driven roller, but the invention is not limited thereto, and the cleaning roller 31 can be a driving roller.

Furthermore, this embodiment shows the example where the card cleaning mechanism 30 indirectly presses the holder 33 holding the cleaning roller 33 to be pressed down, and the cleaning roller 31 is thereby located in the operating position, but the invention is not limited thereto, and the actuator 34 (plunger 34*b*) may directly press the holder 33 so as to position (shift) the cleaning roller 31 in the operating position. Further, this embodiment exemplifies the actuator 34 comprised of a solenoid and plunger as a driving section, but the invention is not limited thereto, and the driving section may use a rotation motor or linear motor.

Moreover, this embodiment exemplifies the card with the magnetic stripe portion and magnetic encoder unit 80, but the invention is not limited thereto. For example, IC cards may be used such that information is written in the IC card in a contactor non/contact manner. Further, this embodiment shows the example where the magnetic encoder unit 80 performs magnetic recording and then, the printing section 50 performs printing in an attempt to reduce the cost when recording failure occurs, but the invention is not limited thereto, and magnetic recording can be performed in the magnetic encoder unit 80 after printing in the printing section 50. Furthermore, either of the printing section 50 and the magnetic encoder unit 80 may perform recording processing. Still furthermore, although this embodiment exemplifies the system configuration with the higher-level apparatus 100, the printer 1 may have a media reading section for reading data recorded in, for example, MO, CD, DVD, etc. and is configured to be operated by recording operation instruction from the operating panel section 5.

Further, this embodiment shows the example where the card C is carried out of the card carrying-out opening 82 when write in the magnetic stripe portion of the card C is failure, but the card C may be transported to the card discharge opening 23 to be discharged to the card holding section 20. Furthermore, the printing-completed card C may be transported along the card transport path P1 and discharged from the card carrying-out opening 82.

Then, this embodiment exemplifies color printing by Y, M, C and Bk in the printing processing in the printing section 50, but the invention is not limited thereto, and for example, printing may be performed using only Bk.

In addition, this application claims priority from Japanese Patent Application No. 2009-18301 incorporated herein by reference.

The invention claimed is:

1. A recording media transporting apparatus comprising:

a substantially linear transport path for transporting a recording medium;

a first transport device provided on the substantially linear transport path for transporting the recording medium;

a second transport device spaced apart from the first transport device on the transport path for further transporting the recording medium from the first transport device;

a cleaning rotating body that is disposed to face the first transport device on the transport path and that has an adhesive portion for cleaning a surface of the recording medium;

a first sensor disposed in an upstream side of a recording medium transport direction relative to the first transport device and the cleaning rotating body; and a control device for controlling rotation speeds of the cleaning rotating body or the first transport device, and the second transport device at a first rotation speed, a second rotation speed lower than the first rotation speed, or a third rotation speed equal to or higher than the first rotation speed, wherein when a front end of the recording medium is sensed by the first sensor, the control device controls the rotation speed of the cleaning rotating body or the first transport device from the first rotation speed to the second rotation speed for a period during which the front end of the recording medium reaches the second transport device from the cleaning rotating body or the first transport device, and when the front end of the recording medium reaches the second transport device, the control device controls the rotation speed of the cleaning rotating body or the first transport device from the second rotation speed to the third rotation speed.

2. The recording media transporting apparatus according to claim 1, further comprising:

an information acquiring device for acquiring information on a thickness of the recording medium, wherein in response to the information on the thickness of the recording medium acquired in the information acquiring device, when the thickness of the recording medium is thinner than a predetermined thickness set beforehand, the control device controls the rotation speed of the cleaning rotating body or the first transport device from the first rotation speed to the second rotation speed for the period during which the front end of the recording medium reaches the second transport device from the cleaning rotating body or the first transport device.

3. The recording media transporting apparatus according to claim 2, wherein the control device determines whether or not the thickness of the recording medium acquired in the information acquiring device is thinner than the predetermined thickness, and controls the rotation speed of the cleaning rotating body or the first transport device from the first rotation speed to the second rotation speed in a positive determination, and the control device maintains the first rotation speed without reducing to the second rotation speed in a negative determination.

4. The recording media transporting apparatus according to claim 2, wherein the information on the thickness of the recording medium acquired in the information acquiring device indicates whether or not the thickness of the recording medium is thinner than a predetermined thickness, and the control device controls the rotation speed of the cleaning rotating body or the first transport device from the first rotation speed to the second rotation speed when the information acquired in the information acquiring device indicates that the thickness of the recording medium is thinner than the predetermined thickness, and the control device maintains the first rotation speed without reducing to the second rotation speed when the information acquired in the information acquiring device indicates that the thickness of the recording medium is thicker than or equal to the predetermined thickness.

5. The recording media transporting apparatus according to claim 2, wherein the information acquiring device has an input device for inputting the information on the thickness of the recording medium.

6. The recording media transporting apparatus according to claim 1, wherein the second transport device is a roller pair, and a space is formed between the cleaning rotating body and a roller of the roller pair disposed on ea cleaning rotating body side via the transport path.

7. The recording media transporting apparatus according to claim 1, wherein the recording medium is transported to the second transport device while being nipped by the cleaning rotating body and the first transport device.

8. The recording media transporting apparatus according to claim 1, further comprising:

a first driving device for driving the first and second transport devices, wherein the cleaning rotating body is a driven rotating body, and the control device changes the rotation speed of the cleaning rotating body indirectly by controlling driving of the first driving device.

9. The recording media transporting apparatus according to claim 1, further comprising:

a first driving device for driving the cleaning rotating body, wherein the control device changes the rotation speed of the cleaning rotating body by controlling driving of the first driving device.

10. A printer provided with a recording media transporting apparatus for transporting the recording media, wherein the recording media transporting apparatus has a configuration of the recording media transporting apparatus according to claim 1.

11. The recording media transporting apparatus according to claim 1, further comprising a second sensor disposed in a downstream side of the recording medium transport direction relative to the second transport device, wherein when the front end of the recording medium is sensed by the first sensor, the control device controls the rotation speed of the cleaning rotating body or the first transport device from the first rotation speed to the second rotation speed, and when the front end of the recording medium is sensed by the second sensor, the control device controls the rotation speed of the cleaning rotating body or the first transport device from the second rotation speed to the third rotation speed.

12. The recording media transporting apparatus according to claim 11, wherein when the first sensor detects the front end of the recording medium, the first transport device rotates at the second rotation speed, and when the second sensor detects the front end of the recording medium, the second transport device rotates at the third rotation speed.

13. The recording media transporting apparatus according to claim 12, wherein when a thickness of the recording medium is thinner than a predetermined thickness, the first transport device rotates at the second rotation speed, and when the thickness of the recording medium is thicker than the predetermined thickness, the first transport device rotates at the first rotation speed.

14. The recording media transporting apparatus according to claim 13, wherein the first sensor detects only the front end of the recording medium and the second sensor detects the front end and a rear end of the recording medium; and when the rear end of the recording medium reaches the second sensor, the cleaning rotating body moves away from the first transport device.

* * * * *